US010100610B2

(12) United States Patent
Johnson

(10) Patent No.: US 10,100,610 B2
(45) Date of Patent: Oct. 16, 2018

(54) BARRIER VALVE CLOSURE METHOD FOR MULTI-ZONE STIMULATION WITHOUT INTERVENTION OR SURFACE CONTROL LINES

(71) Applicant: BAKER HUGHES INCORPORATED, Houston, TX (US)

(72) Inventor: Michael H. Johnson, Katy, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 484 days.

(21) Appl. No.: 14/805,032

(22) Filed: Jul. 21, 2015

(65) Prior Publication Data

US 2017/0022784 A1 Jan. 26, 2017

(51) Int. Cl.

| | |
|---|---|
| ***E21B 34/10*** | (2006.01) |
| *E21B 33/12* | (2006.01) |
| *E21B 43/14* | (2006.01) |
| *E21B 43/26* | (2006.01) |
| *E21B 34/00* | (2006.01) |

(52) U.S. Cl.

CPC ..... *E21B 34/10* (2013.01); *E21B 33/12* (2013.01); *E21B 43/14* (2013.01); *E21B 43/26* (2013.01); *E21B 2034/007* (2013.01)

(58) Field of Classification Search

CPC ..... E21B 2034/002; E21B 34/14; E21B 34/08

See application file for complete search history.

(56) References Cited

U.S. PATENT DOCUMENTS

| | | | |
|---|---|---|---|
| 4,230,185 | A | 10/1980 | Fredd |
| 4,293,038 | A | 10/1981 | Evans |
| 6,041,864 | A | 3/2000 | Patel et al. |
| 7,051,812 | B2 | 5/2006 | McKee et al. |
| 8,261,817 | B2 | 9/2012 | Hayter et al. |
| 8,276,674 | B2 | 10/2012 | Lopez De Cardenas et al. |
| 8,365,832 | B2 | 2/2013 | Martin et al. |
| 8,893,798 | B2 | 11/2014 | Hayter et al. |
| 9,068,417 | B2 | 6/2015 | Swenson et al. |
| 2006/0207764 | A1 | 9/2006 | Rytlewski |
| 2006/0272825 | A1* | 12/2006 | Royer ..... E21B 34/14 166/373 |
| 2011/0192613 | A1 | 8/2011 | Garcia et al. |
| 2012/0267119 | A1 | 10/2012 | Patel |
| 2015/0136392 | A1 | 5/2015 | Jackson et al. |

* cited by examiner

*Primary Examiner* — David J Bagnell
*Assistant Examiner* — Brandon M Duck
(74) *Attorney, Agent, or Firm* — Steve Rosenblatt

(57) ABSTRACT

A barrier valve is operable to close using pressure on a ball landed on a seat associated with a sleeve whose movement opens a port to allow tubing pressure to move the ball to a closed position. Another sleeve is located on the opposite side of the closure ball in the barrier valve. Actuation of the second sleeve opens another passage to allow tubing pressure above ball to rotate the valve member back to an open position with the production tubing in the production packer so that production can begin. The balls disintegrate or disappear by virtue of exposure to well fluids and/or temperatures.

23 Claims, 1 Drawing Sheet

BARRIER VALVE CLOSURE METHOD FOR MULTI-ZONE STIMULATION WITHOUT INTERVENTION OR SURFACE CONTROL LINES

FIELD OF THE INVENTION

The field of the invention is subterranean methods for operating a barrier valve and more particularly in multi-zone stimulation applications for deep wells where it is desired to avoid control lines to the barrier valve or mechanical well intervention.

BACKGROUND OF THE INVENTION

One way a wellbore or zone is stimulated and stimulated is using a series of balls that get progressively larger that land on seats sequentially in an uphole direction. Each time a ball is landed and a portion of the zone is isolated the pressure is built up and fractures are initiated and then propagated as the fluid with proppants is delivered at high flow rates and at high pressure. Other stimulation methods such as acid stimulation can utilize the same method. Outside the string is a series of packers so that the fractures or stimulation are initiated between two set packers in the annular space between the bottom hole assembly and the borehole wall. Eventually the stimulation sleeve tripping balls are either flowed out of the hole when the production string is connected or they disintegrate or otherwise go away. Where the zone is treated pressures used to create the fracture or stimulation can create an overpressured condition or in some cases depending on fluid weights an underbalanced condition can be created which would cause the well to want to flow thus creating a potentially unsafe condition. In some instances, intervals that have been stimulated can begin to have significant fluid losses due to fluid weights and reservoir bottom hole pressures again an undesirable and potentially unsafew condition, there is a need for a barrier valve to retain the formation pressure or control fluid losses as opposed to killing the well with heavy fluids or spotting fluid loss control pills to stabilize wellbore fluids and pressures.

Barrier valves typically are hydraulically operated with control lines conducting hydraulic pressure from the surface to an operating piston or pistons for moving a slide that is eccentrically connected to the ball in the barrier valve. When the slide moves, the ball in the barrier valve rotates shut. The barrier valve is normally run in the borehole in an open position. The control lines have to run through a subsea wellhead in some applications. Ultra deep well locations for the barrier valve mean that one or two control lines have to be run from the surface to the barrier valve at great expense. A single control line system typically works against a pressurized chamber in the barrier valve while a two line system connects to an opposite side of an actuating piston for rotation of the ball in a barrier valve. Ball type barrier valves are sometimes referred to as formation isolation valves.

The barrier valve can also be mechanically actuated with a shifting tool on a supporting string that engages an operating sleeve whose axial movement results in 90 degree ball rotation of the barrier valve. The problem with this mode of operation is that the shifting tool restricts or limits the maximum tripping ball size used to actuate the sleeves during stimulation or alternately it requires a trip in the hole to operate the valve with the shifting tool after stimulation treatments. Alternatively, if the production string is to have the shifting tool on the lower end then the barrier valve cannot be closed until the production string is run and safety issues of the formation coming in occur or the well needs to be killed with heavy fluid to allow the production string to be run in with the well under control.

The hydraulically actuated barrier valves require the expense and risk of damage to one or more control lines.

Other types of barrier valves have been designed to operate on tubing pressure. These typically involve the use of j-slots and pressure cycles that after a predetermined number of pressure application and removal cycles the barrier valve operates. The problem with these designs is that the sequential ball dropping and pressure application that takes place in multi-zone stimulation jobs would have the undesirable effect of operating the valve before it was needed to operate. Experience shows that it would also introduce the complexity of having to keep track of how many cycles there were in the middle of other activities that happen at the surface at the same time. Some of these pressure cycle actuated barrier valves and other designs with complex electrical signaling or hydraulic system actuators are shown in U.S. Pat. No. 9,068,417; U.S. Pat. No. 8,365,832; US20120267119; U.S. Pat. No. 8,261,817; US20150136392; U.S. Pat. No. 8,893,798 and U.S. Pat. No. 7,051,812; U.S. Pat. No. 6,041,864.

The present invention provides a simple way to actuate the barrier valve closed without intervention while also allowing the barrier valve to be later reopened without having to keep track of pressure cycles during stimulation or other operations that require pressure to be applied during completion operations. The valve is operable with tubing pressure. Sleeves are shifted with landed balls to expose access to short hydraulic lines or passages that communicate with the actuator for the barrier valve to turn the ball. The balls that land on seats on the sleeves eventually disintegrate or disappear. These and other features of the present invention will be more apparent to those skilled in the art from a review of the detailed description of the preferred embodiment and the associated drawings while recognizing that the full scope of the invention is to be determined by the appended claims.

SUMMARY OF THE INVENTION

A barrier valve is operable to close using pressure on a ball landed on a seat associated with a sleeve whose movement opens a port to allow tubing pressure to move the ball to a closed position. Another sleeve is located on the opposite side of the closure ball in the barrier valve. Actuation of the second sleeve opens another passage to allow tubing pressure above ball to rotate the valve member back to an open position with the production tubing in the production packer so that production can begin. The balls disintegrate or disappear by virtue of exposure to well fluids and/or temperatures.

DETAILED DESCRIPTION OF THE PREFERRED EMBODIMENT

Figure 1:
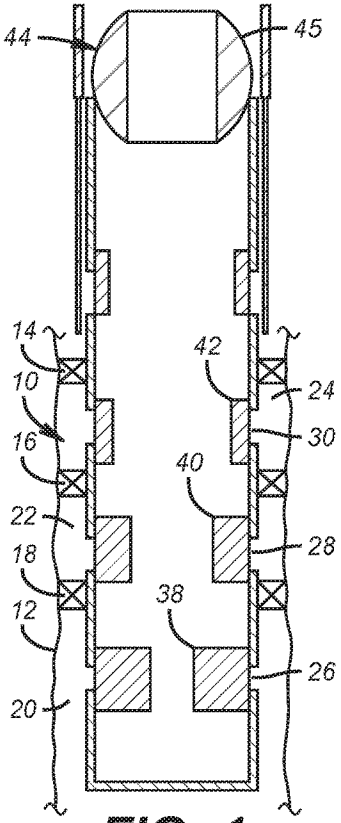
FIG. 1 is a schematic representation of the open barrier valve above ball seats that get progressively larger before the first ball is landed.

Referring to FIG. 1 a bottom hole or body assembly 10 is illustrated in a schematically represented open borehole that is to undergo multi-zone fracture stimulation. Packers 14, 16 and 18 define zones 20, 22 and 24 that are to be fractured/stimulated in a known manner in a bottom up direction by sequential opening of ports 26, 28 and 30 in the known manner by sequentially dropping progressively larger balls 32, 34 and 36 on seats 38, 40 and 42 so that fracking fluid can be sequentially delivered through ports 26, 28 and 30 into zones 20, 22 and 24 also in an known manner. Those skilled in the art will appreciate that the number of zones to be treated is simply illustrative and that typical applications for multi-zone fracture stimulation can involve dozens of progressively larger balls to handle the number of zones to be fractured or stimulated.

Figure 5:
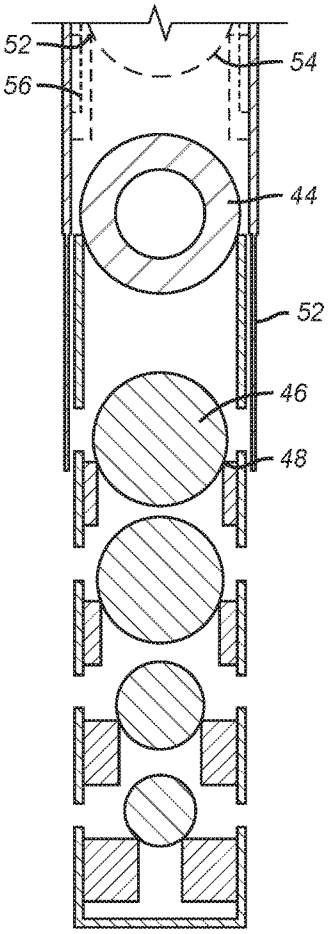
FIG. 5 is the view of FIG. 4 with the closing ball landed and shifted to close the barrier valve and further illustrating the ability to land an even bigger ball to reopen the barrier valve.
Figure 4:
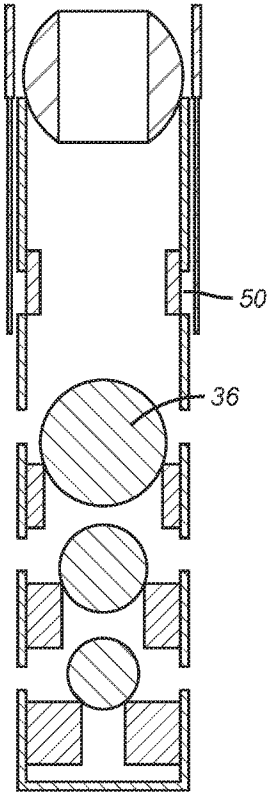
FIG. 4 is the view of FIG. 3 with the third frack ball landed.
Figure 3:
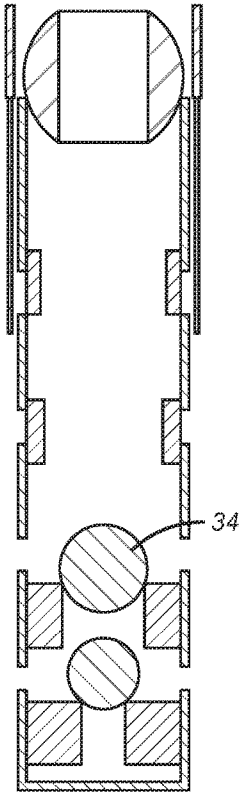
FIG. 3 is the view of FIG. 2 with the second frack ball landed.
Figure 2:
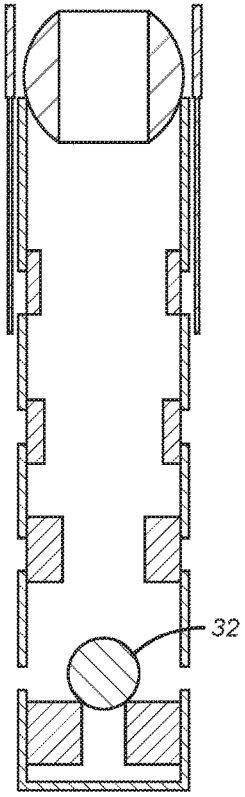
FIG. 2 is the view of FIG. 1 with the first frack ball landed.

Barrier valve 44 is shown in the open position in FIGS. 1-4 to allow the above fracking operations to take place. The valve 44 has a movable valve member 45 that moves from the open to the closed position shown in FIG. 5 by dropping a first object such as a ball 46 onto seat 48 such that movement of the seat 48 and ball 46 that has landed on it with applied pressure with the valve 44 open will result in opening passage 50 shown closed in FIG. 4 and open in FIG. 5. When passage 50 is open, tubing pressure can access a passage that leads to an operating piston whose movement rotates the ball in the valve 44 from an open to a closed position. The assembly of the passage, piston and ball operator are all schematically illustrated as pressure responsive member 52. It should be noted that a shifting sleeve with a linkage offset pinned to a ball and driven either mechanically inside the tubing or hydraulically with external control lines are known constructions for barrier valves. The focus of the present invention is the integration of providing access to tubing pressure when needed to operate the valve 44 between open and closed positions. This can be done with a single application of pressure to close the valve 44 through port 50 when selectively open. A mirror image assembly showing a seat 52 that can accept a second object such as a ball 54 and open another port that is not shown for access to a passage leading to the valve 44 actuator to open valve 44 and is collectively labeled pressure responsive member 56. Alternatively, the production string can have a shifter tool to mechanically or otherwise open the valve 44 by shifting a sleeve. Ball 46 is smaller than ball 54 to allow sequential operation that first closes valve 44 and then opens it. Some or all of the balls can be made of a material that disintegrates or disappears in the presence of well fluids, or due to thermal loads from well fluids or by other environmental interactions that result in ultimate removal of the balls when production is to take place after a production string is connected to a production packer in the known way that is not shown.

Those skilled in the art will appreciate that what is illustrated is a unique arrangement for a barrier valve that allows operation without intervention and with a single pressure application with no need to run control lines to the surface. While the illustrated embodiment shows a first movable sleeve below the valve 44 as opening an access port that facilitates closing and another sleeve on the uphole side of valve 44 to open another port to allow subsequent opening, the valve movements can occur in opposed order.

While the preferred embodiment shows landed balls on seats moving sleeves to open access ports for selective valve operation with tubing pressure, other mechanisms can be used to move the sleeves to open the access ports without intervention. The sleeves that exposed the access ports can be shifted with flow through them that creates a sufficient net force to break a shear pin with the two sleeves for closing and opening the valve set at different levels of shear for sequential operation. The sleeves can be associated with motors and a power source that is remotely triggered to move the sleeves as needed.

The above description is illustrative of the preferred embodiment and many modifications may be made by those skilled in the art without departing from the invention whose scope is to be determined from the literal and equivalent scope of the claims below.

I claim:

1. A barrier valve assembly for a tubular string extending to a subterranean location, comprising:

a body assembly having a passage therethrough and a valve member movable for selectively closing or opening said passage;

a pressure responsive actuator assembly on said body and having a first configuration where applied pressure in said passage does not actuate said actuator assembly and a second configuration where pressure in said passage actuates said actuator assembly and wherein pressure access to said actuator for operation of said valve member by said actuator assembly in said second configuration is obtained with pressure buildup in said passage that opens an access port to communicate passage pressure to said actuator assembly, said access port located on at least one side of said valve member.

2. A barrier valve assembly for a tubular string extending to a subterranean location, comprising:

a body assembly having a passage therethrough and a valve member movable for selectively closing or opening said passage;

a pressure responsive actuator assembly on said body and selectively communicating with said passage on at least one side of said valve member, whereupon when pressure from said passage can reach said actuator assembly, said valve member is moved between positions where said passage is open or closed;

access between said passage and said pressure responsive actuator assembly is controlled with at least one movable sleeve selectively covering at least one port leading from said passage.

3. A barrier valve assembly for a tubular string extending to a subterranean location, comprising:

a body assembly having a passage therethrough and a valve member movable for selectively closing or opening said passage;

a pressure responsive actuator assembly on said body and selectively communicating with said passage on at least one side of said valve member, whereupon when pressure from said passage can reach said actuator assembly, said valve member is moved between positions where said passage is open or closed;

access between said passage and said pressure responsive actuator assembly is controlled with at least one movable sleeve selectively covering at least one port leading from said passage;

said sleeve comprises a seat surrounding a through opening;

said seat accepts an object to obstruct said passage such that pressure applied to said object with said passage obstructed shifts said sleeve to open said port.

4. The assembly of claim 3, wherein:

said object is removed from said seat after a predetermined time.

5. The assembly of claim 4, wherein:

said object is made from a material that interacts with fluid or temperature at the subterranean location to disintegrate or otherwise be removable from blocking said passage.

6. The assembly of claim 3, wherein:

said object comprises a sphere.

7. A barrier valve assembly for a tubular string extending to a subterranean location, comprising:

a body assembly having a passage therethrough and a valve member movable for selectively closing or opening said passage;

a pressure responsive actuator assembly on said body and selectively communicating with said passage on at least one side of said valve member, whereupon when pressure from said passage can reach said actuator assembly, said valve member is moved between positions where said passage is open or closed;

access between said passage and said pressure responsive actuator assembly is controlled with at least one movable sleeve selectively covering at least one port leading from said passage;

said sleeve is moved to expose said port with flow therethrough or with a remotely signaled motor and power supply associated therewith.

8. A barrier valve assembly for a tubular string extending to a subterranean location, comprising:

a body assembly having a passage therethrough and a valve member movable for selectively closing or opening said passage;

a pressure responsive actuator assembly on said body and selectively communicating with said passage on at least one side of said valve member, whereupon when pressure from said passage can reach said actuator assembly, said valve member is moved between positions where said passage is open or closed;

said valve member is moved between positions where said passage is open and closed.

9. The assembly of claim 8, wherein:

access between said passage and said pressure responsive actuator assembly is controlled with a first and second movable sleeves selectively respectively covering a first and second ports leading from said passage.

10. The assembly of claim 9, wherein:

said first and second sleeves respectively comprise a first and second seat surrounding a through opening;

said seats respectively accept discrete first and second objects to obstruct said passage such that pressure applied to said first object with said passage obstructed shifts said first sleeve to open said first port for valve member movement in a first direction and pressure applied to said second object with said passage obstructed shifts said second sleeve to open said second port for valve member movement in a second direction opposite said first direction.

11. The assembly of claim 10, wherein:

said first and second sleeves are disposed on opposite sides of said valve member.

12. The assembly of claim 11, wherein:

said second object is larger than said first object.

13. The assembly of claim 12, wherein:

said first and second object comprise spheres and said valve member comprises a rotatably mounted sphere with a flowpath therethrough that selectively aligns with said passage.

14. The assembly of claim 10, wherein:

said first object is landed on said first seat located below said valve member for closing said passage and said second object is landed second on said second seat above said valve member to open said passage.

15. A multizone fracture/stimulation method, comprising:

sequentially fracturing/stimulating multiple zones through a tubular string with progressively larger objects landed on different seats in sleeves in said tubing string that shift to open ports in a wall of said tubing string through which pressurized fluid is delivered into the zones;

exposing a pressure responsive actuator for a barrier valve in said tubular string to tubing string pressure after said sequentially fracturing/stimulating;

applying pressure in said tubular string to change the position of said barrier valve.

16. The method of claim 15, comprising:

exposing said pressure responsive actuator to tubing pressures at two locations sequentially for selective closing and opening of said barrier valve.

17. The method of claim 15, comprising:

opening a first port with a first sliding sleeve movement to expose said pressure responsive actuator to pressure in said tubular string.

18. The method of claim 17, comprising:

applying pressure once to a predetermined value in said first port to move said barrier valve.

19. The method of claim 17, comprising:

locating a first ball on a first seat associated with said first sliding sleeve to open said first port.

20. The method of claim 19, comprising:

locating a second ball bigger than said first ball onto a second seat associated with a second sliding sleeve to open a second port.

21. The method of claim 20, comprising:

locating said first and second ports on opposite sides of a valve member in said barrier valve.

22. The method of claim 21, comprising:

locating said second ball after locating said first ball;

closing the barrier valve with said first ball and opening the barrier valve with said second ball.

23. The method of claim 22, comprising:

removing said first and second balls respectively from said first and second seats by disintegration or other failure mode induced by borehole fluid or temperature adjacent said zones.

* * * * *